US011381026B1

(12) United States Patent
Probert et al.

(10) Patent No.: US 11,381,026 B1
(45) Date of Patent: Jul. 5, 2022

(54) ELECTRICAL CONNECTOR PROTECTOR PLATE WITH TERMINAL POSITION ASSURANCE

(71) Applicant: Lear Corporation, Southfield, MI (US)

(72) Inventors: Deborah Probert, Farmington Hills, MI (US); David Menzies, Linden, MI (US); Lewis Galligan, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/136,835

(22) Filed: Dec. 29, 2020

(51) Int. Cl.

| | |
|---|---|
| ***H01R 13/436*** | (2006.01) |
| ***H01R 13/627*** | (2006.01) |
| ***H01R 13/631*** | (2006.01) |
| *H01R 13/629* | (2006.01) |
| *H01R 13/432* | (2006.01) |

(52) U.S. Cl.
CPC ..... *H01R 13/4365* (2013.01); *H01R 13/6273* (2013.01); *H01R 13/631* (2013.01); *H01R 13/432* (2013.01); *H01R 13/62933* (2013.01)

(58) Field of Classification Search
CPC . H01R 13/6275; H01R 13/635; H01R 12/722
See application file for complete search history.

(56) References Cited

U.S. PATENT DOCUMENTS 6,004,158 A * 12/1999 Ward ..... H01R 13/4361 439/595
6,074,237 A * 6/2000 Lee ..... H01R 4/2433 439/358
6,217,354 B1 * 4/2001 Fencl ..... H01R 13/62977 439/157
6,305,990 B1 * 10/2001 Ward ..... H01R 13/432 439/752
6,558,176 B1 * 5/2003 Martin ..... H01R 13/62944 439/157
6,666,698 B2 12/2003 Beck, Jr. et al.
6,739,889 B1 * 5/2004 Daggett ..... H01R 13/62938 439/157
7,670,177 B2 * 3/2010 Myer ..... H01R 13/4538 439/595
8,038,455 B1 * 10/2011 Moraes ..... H01R 13/4538 439/140
8,075,351 B2 * 12/2011 Park ..... H01R 13/4538 439/752
8,961,245 B2 * 2/2015 Kowtun ..... B60R 16/0238 439/723
9,112,294 B2 * 8/2015 Pade ..... H01R 13/436
9,509,081 B2 * 11/2016 Kobayashi ..... H01R 13/506
9,520,669 B2 12/2016 Gerwatowski et al.
9,525,238 B1 * 12/2016 Luksic ..... H01R 13/6273
10,153,586 B1 * 12/2018 Schroll ..... H01R 13/6272
10,181,679 B1 * 1/2019 Probert ..... H01R 13/502
(Continued)

*Primary Examiner* — Abdullah A Riyami
*Assistant Examiner* — Nader J Alhawamdeh
(74) *Attorney, Agent, or Firm* — MacMillan, Sobanski & Todd, LLC

(57) ABSTRACT

A protector plate for use with an electrical connector has a protector body. The protector body has a front plate face and an opposed back plate face. The protector plate includes one or more terminal openings that pass through the protector body. A plurality of staged locks are attached to the protector body for relative rotational movement. The staged locks extend beyond the front plate face. The staged locks also extend beyond the back plate face.

21 Claims, 14 Drawing Sheets

(56) References Cited

U.S. PATENT DOCUMENTS

| | | | | |
|---|---|---|---|---|
| 10,193,276 | B1 | 1/2019 | Lanzotti et al. | |
| 10,218,124 | B1 * | 2/2019 | Probert | H01R 13/62955 |
| 10,236,629 | B2 | 3/2019 | Narro et al. | |
| 10,270,208 | B1 * | 4/2019 | Probert | H01R 13/641 |
| 10,312,626 | B2 * | 6/2019 | Vasbinder | H01R 13/631 |
| 10,454,199 | B1 * | 10/2019 | Christiano | H01R 13/4368 |
| 10,490,938 | B2 * | 11/2019 | Probert | H01R 13/62938 |
| 10,897,103 | B1 * | 1/2021 | Sundarakrishnamachari | H01R 13/4368 |
| 10,971,856 | B1 * | 4/2021 | Reynoso Galvan | H01R 13/502 |
| 2002/0182923 | A1 * | 12/2002 | Li | H01R 13/627 439/357 |
| 2006/0040533 | A1 * | 2/2006 | Koshy | H01R 13/62977 439/157 |
| 2009/0311896 | A1 * | 12/2009 | Myer | H01R 13/4365 439/248 |
| 2010/0227495 | A1 * | 9/2010 | Matsumura | H01R 13/631 439/374 |
| 2014/0099841 | A1 * | 4/2014 | Schmatz | H01R 13/432 439/872 |
| 2019/0123483 | A1 * | 4/2019 | Probert | H01R 13/502 |
| 2019/0123485 | A1 * | 4/2019 | Probert | H01R 13/62966 |

* cited by examiner

ELECTRICAL CONNECTOR PROTECTOR PLATE WITH TERMINAL POSITION ASSURANCE

BACKGROUND OF THE INVENTION

This invention relates in general to an electrical connector. More specifically, this invention relates to an electrical connector with a protector plate for male electrical terminals.

An electrical connector assembly is typically used to provide simultaneous and reliable connections between multiple electrical terminals. The electrical connector assembly normally includes a first (such as a male) connector assembly and a second (such as a female) connector assembly that support respective pluralities of complementary electrical terminals that are mated when the male and female connector assemblies are mated. An example of such an electrical connector assembly is described in U.S. Pat. No. 10,218,124.

The electrical connector assembly described in the '124 patent is configured to accommodate multiple electrical terminals of various sizes, including multiple relatively small electrical terminals. It is desirable to have an electrical connector assembly that helps protect the electrical terminals from damage during assembly and use of the electrical connector assembly.

SUMMARY OF THE INVENTION

The invention relates to a protector plate for use with an electrical connector assembly. The protector plate has a protector body. The protector body has a front plate face and an opposed back plate face. The protector plate includes one or more terminal openings that pass through the protector body. A plurality of staged locks are attached to the protector body for relative rotational movement. The staged locks extend beyond the front plate face. The staged locks also extend beyond the back plate face.

Another embodiment of the invention relates to an electrical connector assembly that includes a housing. The electrical connector assembly also includes a protector plate. The protector plate has a protector body. The protector body has a front plate face and an opposed back plate face. One or more terminal openings pass through the protector body. A plurality of staged locks are attached to the protector body for relative rotational movement. The staged locks extend beyond the front plate face. The staged locks also extend beyond the back plate face. The protector plate is movable relative to the housing in a mate direction from a pre-stage position to a pre-lock position. The protector plate is retained in the pre-lock position relative to the housing against further movement in the mate direction by the staged lock.

In another embodiment of the invention, an electrical connector assembly includes a first connector assembly and a second connector assembly. The second connector assembly is movable relative to the first connector assembly to engage a release surface on the staged lock. The second connector assembly engages the staged lock to move the staged lock in a release direction to release the protector plate from the stop.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
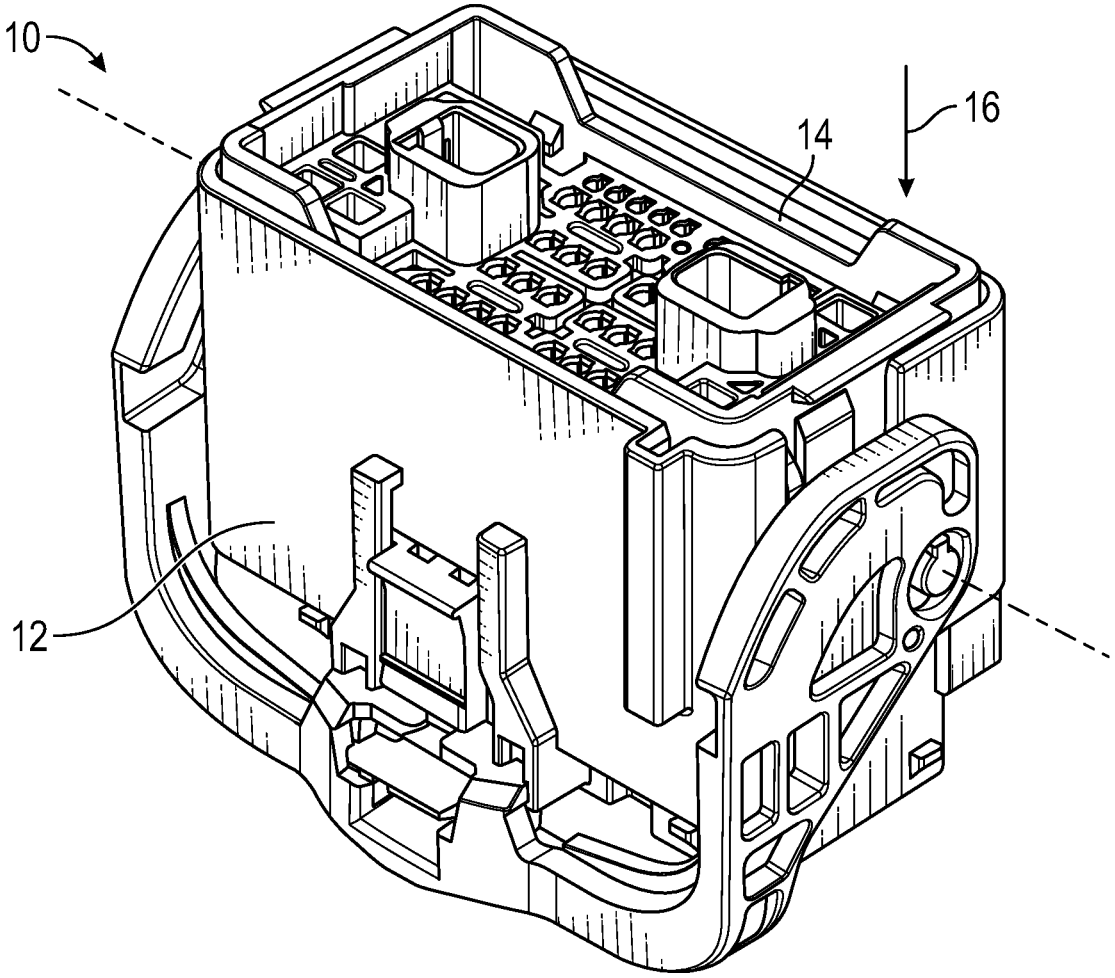
FIG. 1 (Prior Art)
FIG. 1 is a perspective view of a prior art electrical connector assembly.

Referring now to the drawings, there is illustrated in FIG. 1 a perspective view of a prior art electrical connector assembly, indicated generally at 10. The prior art electrical connector assembly 10 is similar to the electrical connector assembly with terminal position assurance described and illustrated in the '124 patent, the disclosure of which is hereby incorporated by reference.

Figure 2:
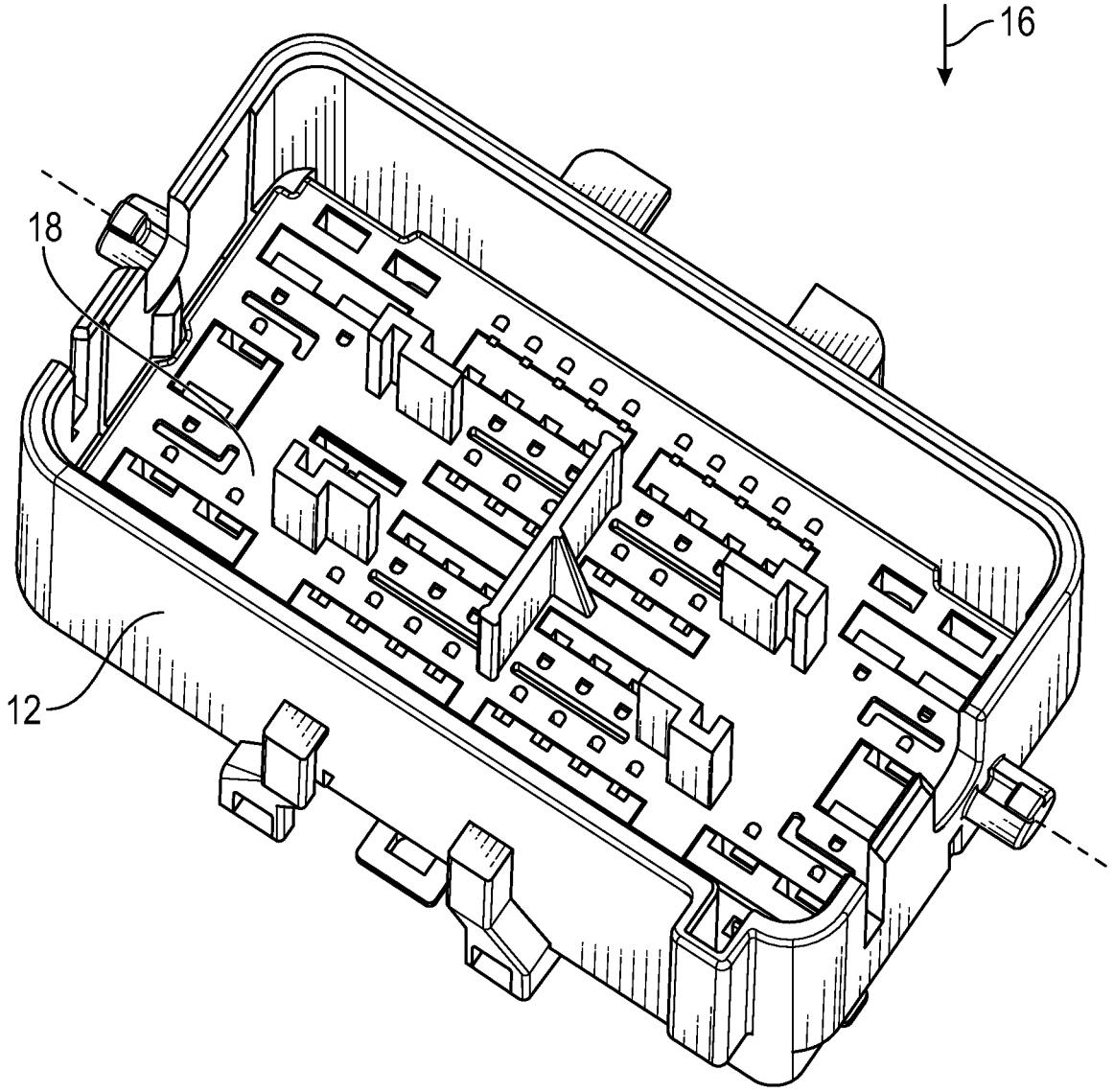
FIG. 2 (Prior Art)
FIG. 2 is a perspective view of a first housing of the prior art electrical connector assembly illustrated in FIG. 1.
Figure 3:
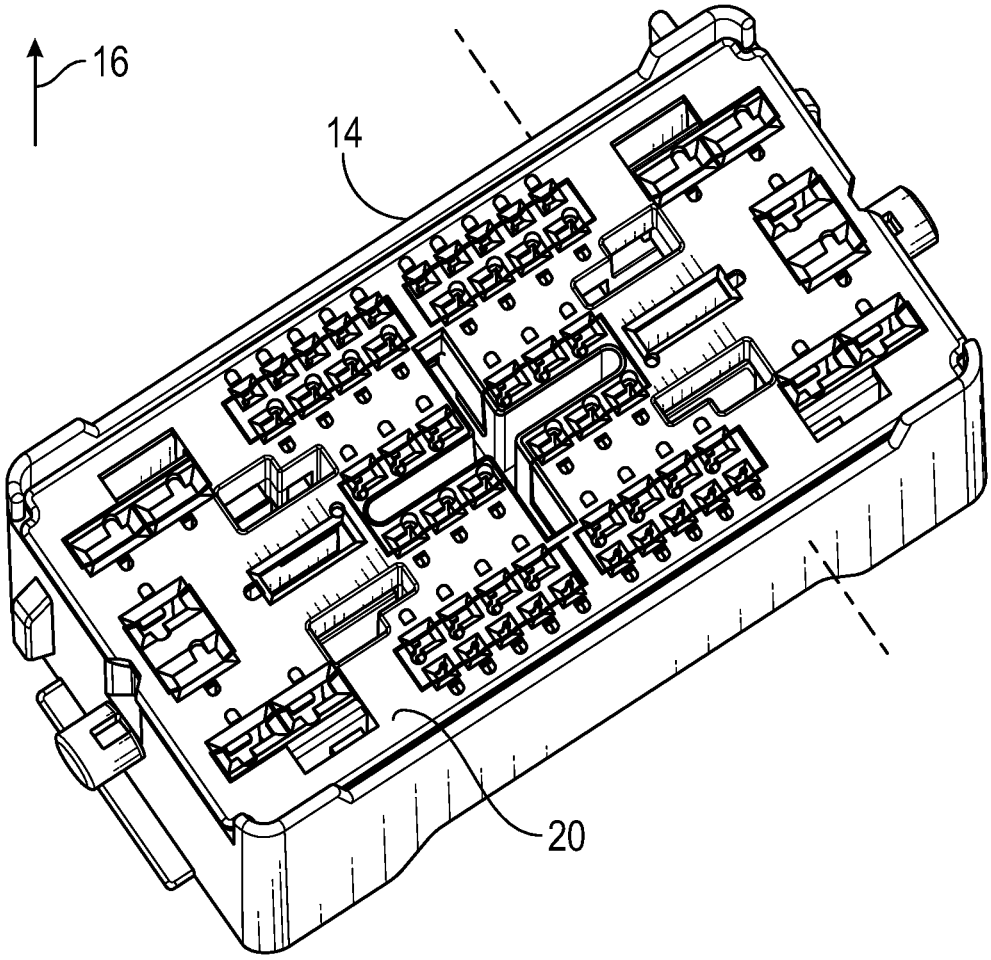
FIG. 3 (Prior Art)
FIG. 3 is a perspective view of a second housing of the prior art electrical connector assembly illustrated in FIG. 1.

The prior art electrical connector assembly 10 includes a first housing 12 and a second housing 14 that is configured be moved in an insertion direction 16 relative to the first housing 12 in order to mate with the first housing 12. The second housing 14 is shown in a seated position relative to the first housing 12 in FIG. 1. Referring to FIG. 2, a perspective view of the first housing 12 is illustrated. A first terminal position assurance 18 is connected to the first housing 12. Referring to FIG. 3, a perspective view, from below, of the second housing 14 is illustrated. A second terminal position assurance 20 is connected to the second housing 12. The first terminal position assurance 18 and the second terminal position assurance 20 serve to retain respective pluralities of electrical terminals (not shown) in the first housing 12 and the second housing 14, respectively.

Figure 4:
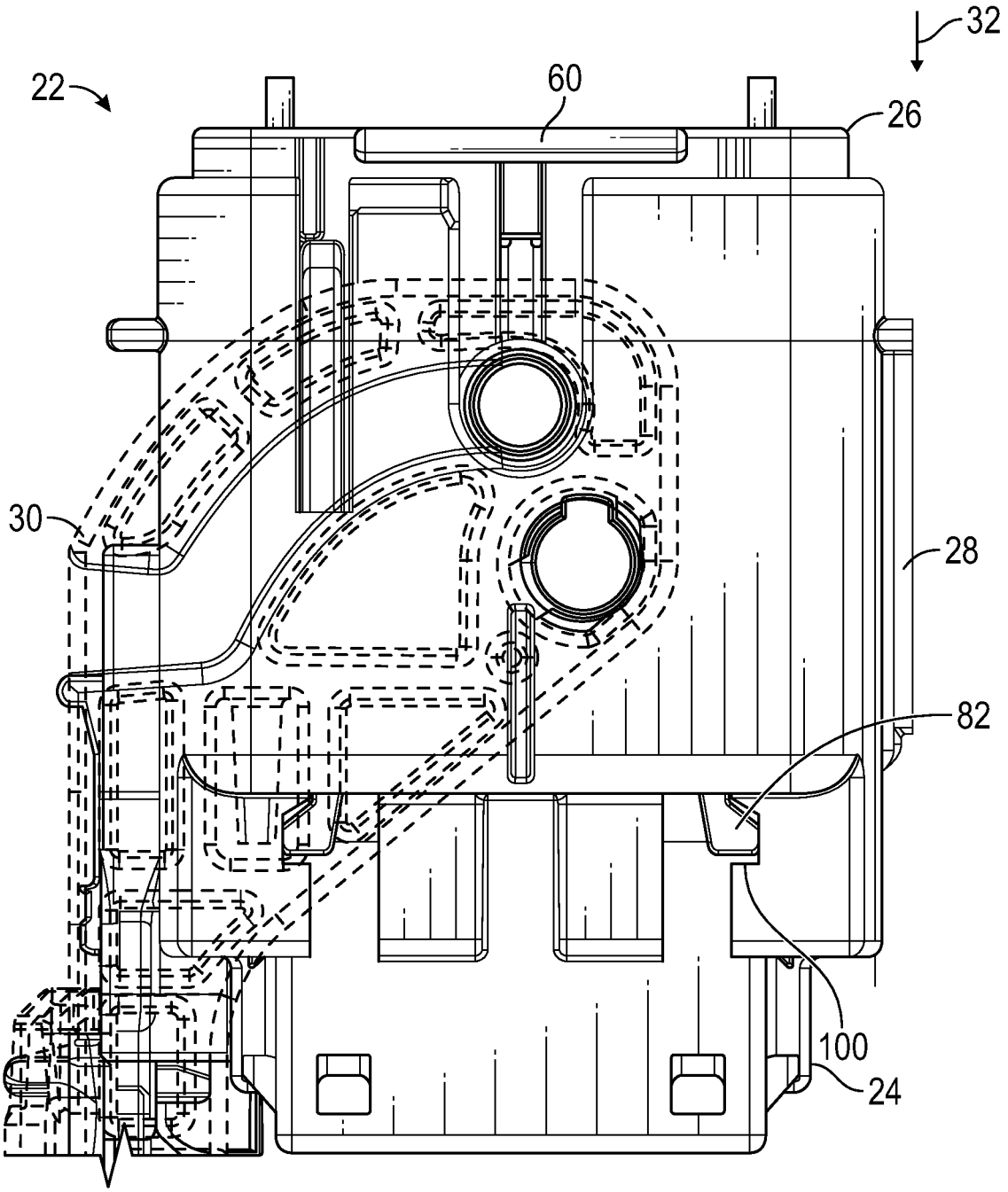
FIG. 4 is a side elevational view of a first embodiment of an electrical connector assembly in accordance with this invention.

Referring now to FIG. 4, there is illustrated a side view of a first embodiment of an electrical connector assembly, indicated generally at 22, in accordance with this invention. The illustrated electrical connector assembly 22 includes features that are similar to the electrical connector assembly with terminal position assurance described in the '124 patent. However, the invention may be used with any desired electrical connector.

The electrical connector assembly 22 includes a first connector assembly 24 and a second connector assembly 26. The first connector assembly 24 includes a first housing 28 and an attached assist lever 30. The lever 30 engages the second connector assembly 26 and is operable to pull the second connector assembly 26 in a mate direction 32 relative to the first connector assembly 24 into a mated position. The operation of the assist lever 28 is similar to the lever described in the '124 patent. The first connector assembly 24 is illustrated in the mated position relative to the second connector assembly 26 in FIG. 4.

Figure 5:
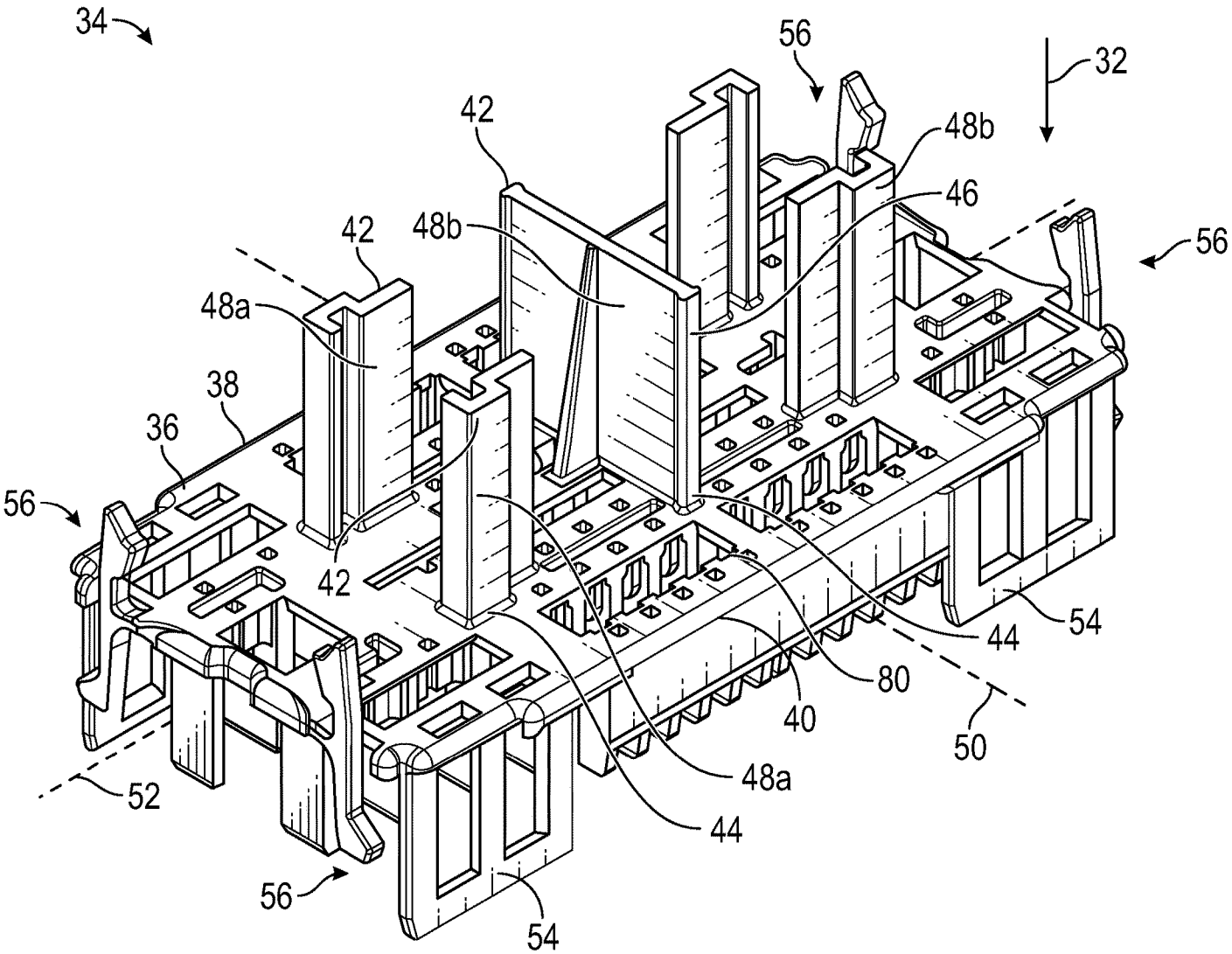
FIG. 5 is a perspective view of a protector plate of the electrical connector assembly illustrated in FIG. 4.
Figure 6:
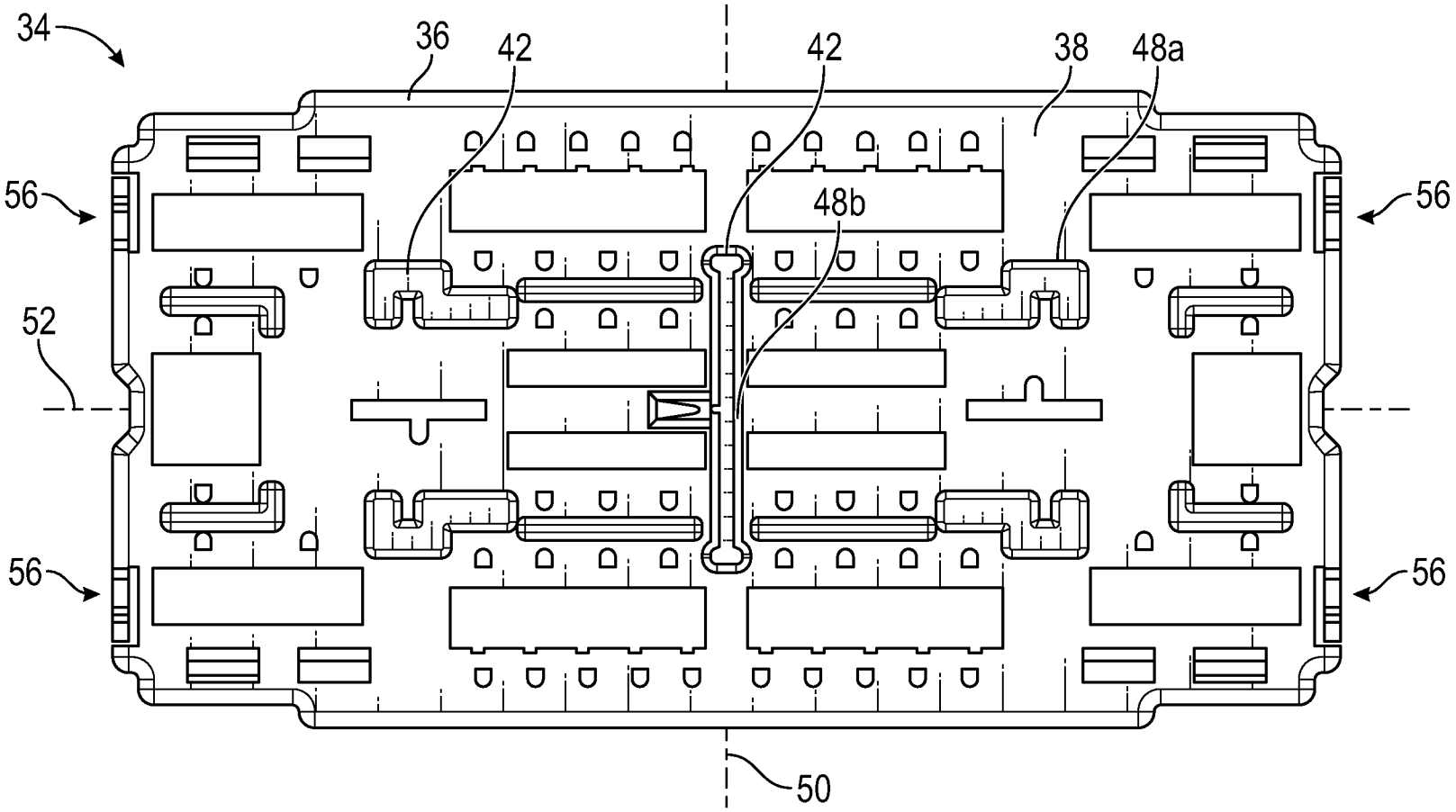
FIG. 6 is a top plan view of the protector plate illustrated in FIG. 5.

Referring now to FIG. 5, there is illustrated a perspective view of a protector plate, indicated generally at 34. A top plan view of the protector plate 34 is illustrated in FIG. 6. The illustrated protector plate 34 serves as a both a protector plate and a terminal position assurance for the first connector assembly 24, as will be described below. The illustrated protector plate 34 includes features that are similar to the first terminal position assurance described in the '124 patent.

The illustrated protector plate 34 is molded from plastic, but may be made of any desired material using any desired process. The illustrated protector plate 34 is a single piece, but may be made of more than one piece, if desired. The protector plate 34 includes a protector body 36. The illustrated protector body 36 is substantially planar, but may have any desired shape. The protector body 36 includes a front plate face 38 and an opposed back plate face 40.

A plurality of towers 42 extend from the front plate face 38 of the protector plate 34. Each tower 42 includes a respective tower base 44 adjacent to the protector body 36 and a respective tower outer end 46. The towers 42 are tapered so that the outer end 46 of each tower 42 defines a cross-section, taken perpendicular to the mate direction 32, that is smaller than the cross-section of the associated tower base 44.

The illustrated towers 42 include forward walls **48*a* and substantially perpendicular cross walls 48*b*. The forward walls 48*a* and the cross walls 48*b* extend from the associated tower base 44 to the associated tower outer end 46 of each tower 42. The forward walls 48*a* and the cross walls 48*b* extend from the front plate face 38 substantially in the mate direction 32, but at an angle to the mate direction 32 in order to allow for the taper of the towers 42. The forward walls 48*a* face generally along a first axis 50 that is substantially perpendicular to the mate direction 32, and the cross walls 48*b* face generally along a second axis 52 that is substantially perpendicular to the mate direction 32 and substantially perpendicular to the first axis 50. The forward walls 48*a* and the cross walls 48*b* assist in the aligning of the protector plate 34 relative to the second connector assembly 26 during mating of the electrical connector assembly 22, as will be described below. In the illustrated embodiment, some of the towers 42 have a question mark-shaped cross-section and include both forward walls 48*a* and cross walls 48*b*. However, the towers 42** may have any desired shapes.

Protector plate locks 54 extend from the back plate face 40 of the protector body 36. The protector plate locks 54 are resilient arms that engage the first housing 28 to retain the protector plate 34 in position relative to the first housing 28. The illustrated protector plate 34 includes four protector plate locks 54 (three are visible in FIG. 5), but may include any desired number of locks and any desired retaining structure.

The protector plate 34 includes a plurality of staged locks, indicated generally at 56. The illustrated protector plate 34 includes four staged locks 56, but may include any desired number. Each of the staged locks 56 extends from the protector body 36 and is molded as part of the protector plate 34. The staged locks 56 extend beyond the front plate face 38 and beyond the back plate face 40. The staged locks 56 will be described in detail below.

Figure 7:
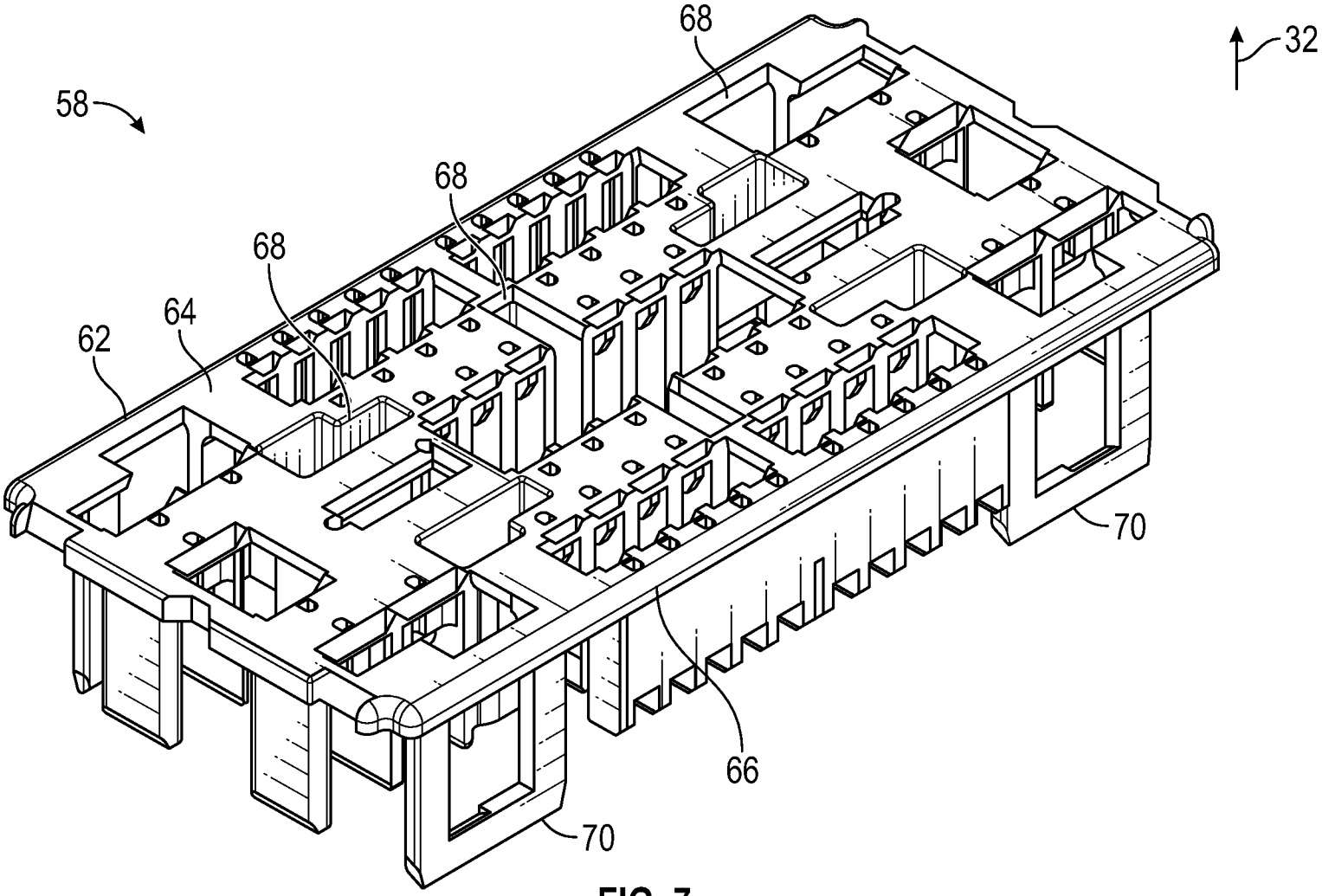
FIG. 7 is a perspective view of a second terminal position assurance of the electrical connector assembly illustrated in FIG. 4.
Figure 8:
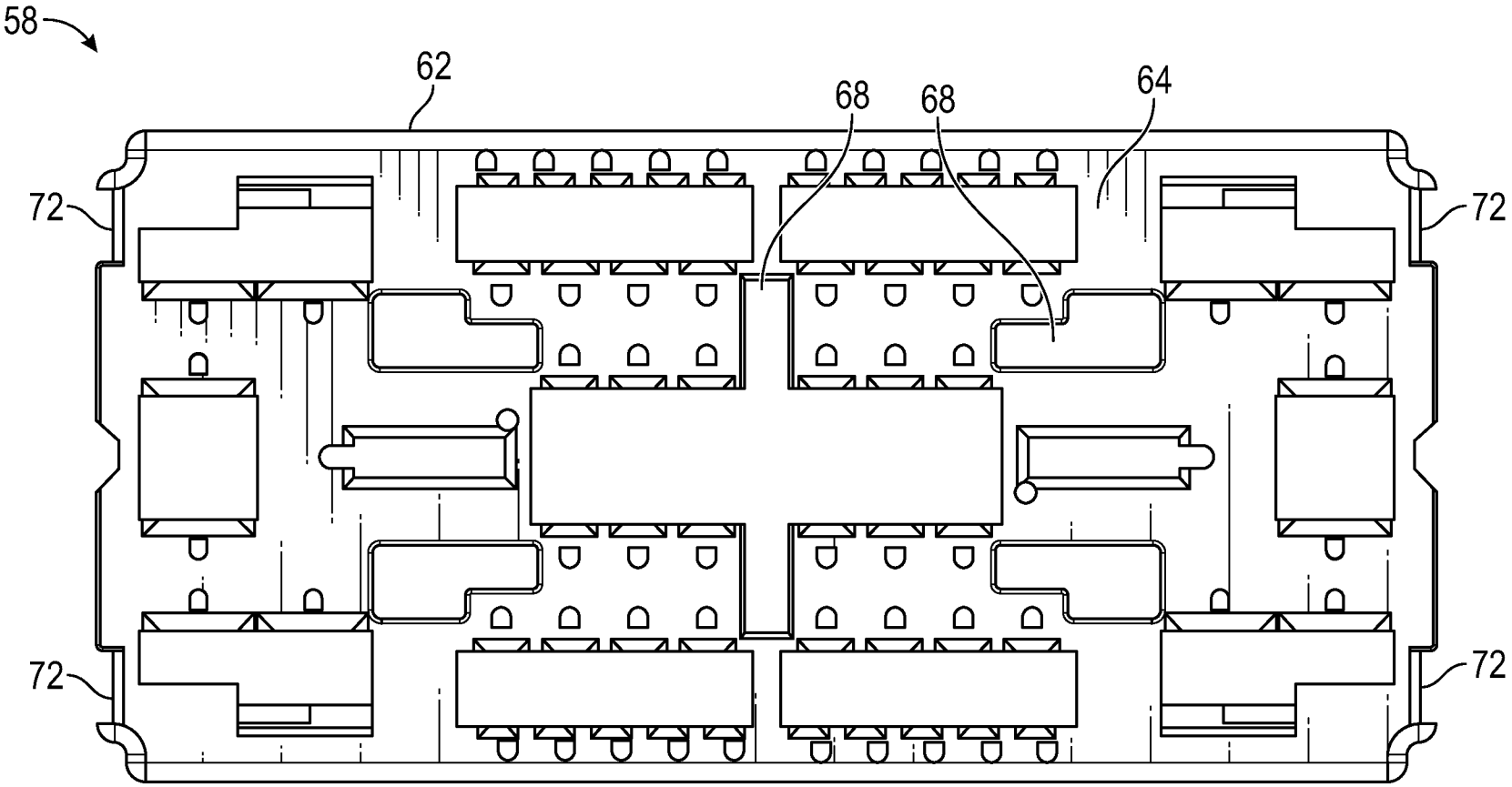
FIG. 8 is a top plan view of the second terminal position assurance illustrated in FIG. 7.

Referring now to FIG. 7, there is illustrated a perspective view of a second terminal position assurance, indicated generally at 58. A top plan view of the second terminal position assurance 58 is illustrated in FIG. 8. The second terminal position assurance 58 is attached to a second housing 60 (shown in FIG. 4) as part of the second connector assembly 26 and serves as a terminal position assurance for the second connector assembly 26. The illustrated second terminal position assurance 58 includes features that are similar to the second terminal position assurance described in the '124 patent.

The illustrated second terminal position assurance 58 is molded from plastic, but may be made of any desired material using any desired process. The illustrated second terminal position assurance 58 is a single piece, but may be made of more than one piece, if desired. The second terminal position assurance 58 includes a second terminal position assurance body 62. The illustrated second terminal position assurance body 62 is substantially planar, but may have any desired shape. The second terminal position assurance 58 includes a front face 64 and an opposed back face 66.

A plurality of tower openings 68 extend through the second terminal position assurance body 62. The tower openings 68 are sized and positioned to accommodate the towers 42 on the protector plate 34 when the first connector assembly 24 is mated with the second connector assembly 26.

Second terminal position assurance locks 70 extend from the back face 66 of the second terminal position assurance body 62. The second terminal position assurance locks 70 are resilient arms that engage the second housing 60 to retain the second terminal position assurance 58 in position relative to the second housing 60. The illustrated second terminal position assurance 58 includes four second terminal position assurance locks 70 (three are visible in FIG. 7), but may include any desired number of locks, and may include any desired retaining structure.

The second terminal position assurance 58 also includes a plurality of lock openings 72. The lock openings 72 extend through the second terminal position assurance body 62. The illustrated second terminal position assurance 58 includes four lock openings 72, but may include any desired number. Each of the lock openings 72 is provided to accommodate one of the staged locks 56 when the first connector assembly 24 is mated with the second connector assembly 26, as described below.

Figure 9A:
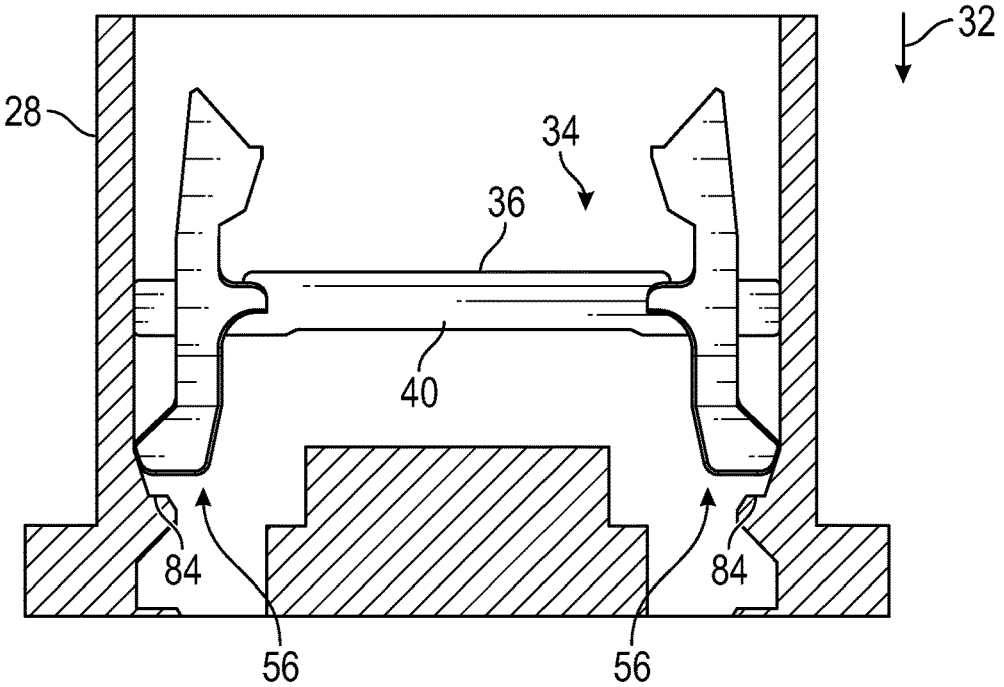
FIG. 9A is a cross-sectional view of a first connector assembly of the electrical connector assembly illustrated in FIG. 4 showing the protector plate in a pre-stage position in a first housing.

Referring now to FIG. 9A, there is illustrated a cross-sectional view of the first connector assembly 24 shown with the protector plate 34 in a pre-stage position. In FIG. 9A, the protector body 36 and the staged locks 56 are the only parts of the protector plate 34 illustrated so that the operation of the staged locks 56 may be clearly shown. In order to put the first connector assembly 24 in the pre-stage position, the protector plate 34 is positioned with the back plate face 40 facing the first housing 28, and the protector plate 34 is moved in the mate direction 32 relative to the first housing 28.

Figure 9B:
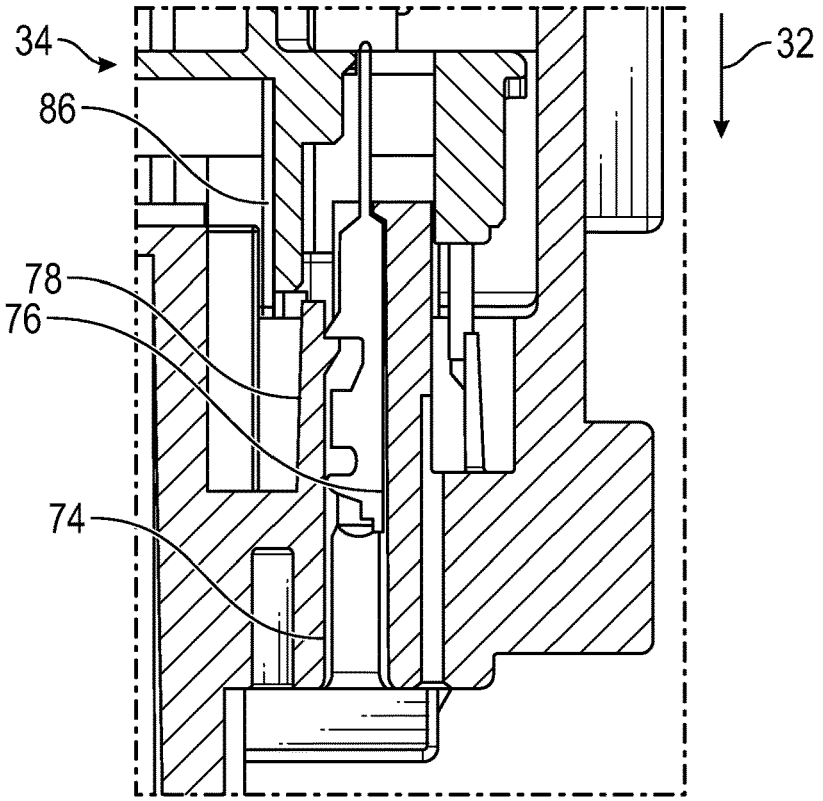
FIG. 9B is a cross-sectional view of an electrical terminal installed in the first housing and retained in a terminal cavity by a terminal lock.

FIG. 9B illustrates an enlarged, cross-sectional view of a portion of the first connector assembly 24 in the pre-stage position. The first housing 28 includes a plurality of terminal cavities 74. Each terminal cavity 74 is adapted to accommodate an electrical terminal 76 (one is shown in FIG. 9B) and includes a respective terminal lock 78 that is adapted to retain the electrical terminal 76 in the respective terminal cavity 74. When the protector plate 34 is located in the pre-stage position, the electrical terminal 76 may be inserted into the terminal cavity 74, and the terminal lock 78 is operable to retain the electrical terminal 76 in the terminal cavity 74. Additionally, when the protector plate 34 is located in the pre-stage position, the terminal lock 78 is operable to allow the electrical terminal 76 to be removed from the terminal cavity 74, as is known in the art.

As shown, when the electrical terminal 76 is installed in the terminal cavity 74, it extends parallel to the mate direction 32 from the terminal cavity 74. The electrical terminal 76 extends past the back plate face 40, through a terminal opening 80 in the protector body 36, and beyond the front place face 38. The illustrated protector plate 34 includes a plurality of terminal openings 80 to accommodate each of the terminal cavities 74.

Figure 10A:
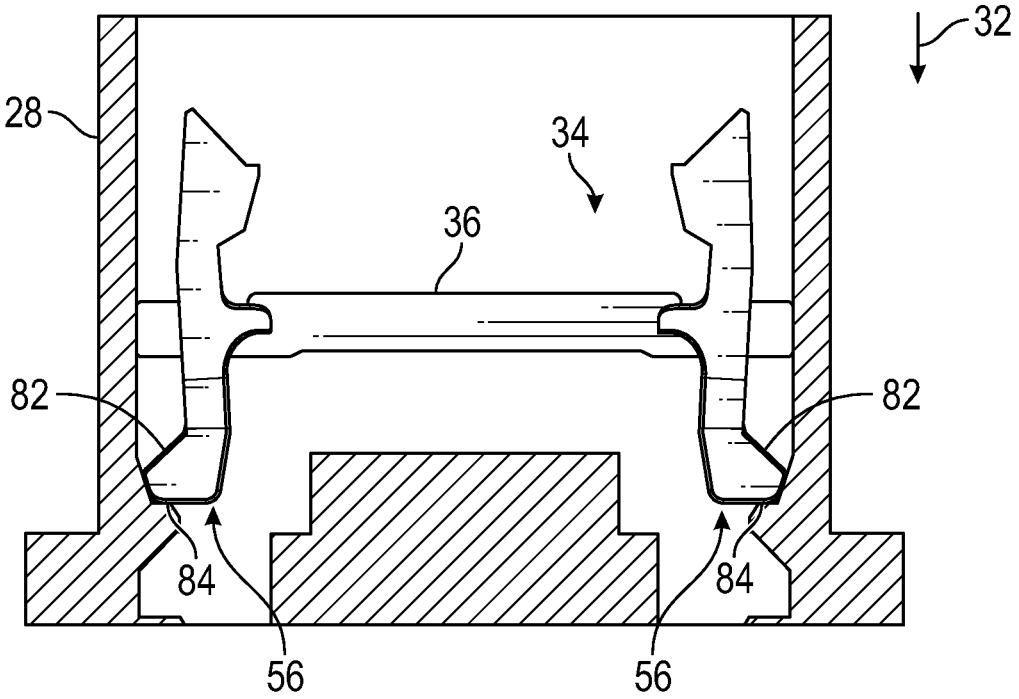
FIG. 10A is a cross-sectional view similar to FIG. 9A showing the protector plate in a pre-lock position.

Referring now to FIG. 10A, there is illustrated a cross-sectional view similar to FIG. 9A, with the protector plate 34 shown moved relative to the first housing 28 to a pre-lock position. In order to put the first connector assembly 24 in the pre-lock position, the protector plate 34 is moved from the pre-stage position in the mate direction 32 relative to the first housing 28. The protector plate 34 may be moved to the pre-lock position by an assembler pushing the protector plate 34 in the mate direction 32. The assembler may be a human technician, an automated machine, or any other desired mechanism.

The staged locks 56 include a foot 82 that engages a stop 84 on the first housing 28 when the protector plate is moved to the pre-lock position. The foot 82 engages the stop 84 to prevent further movement of the protector plate 34 in the mate direction 32. When the protector plate 34 is moved to the pre-lock position, the protector plate locks 54 engage the first housing 28 to prevent the protector plate 34 from being moved opposite the mate direction 32 relative to the first housing 28.

Figure 10B:
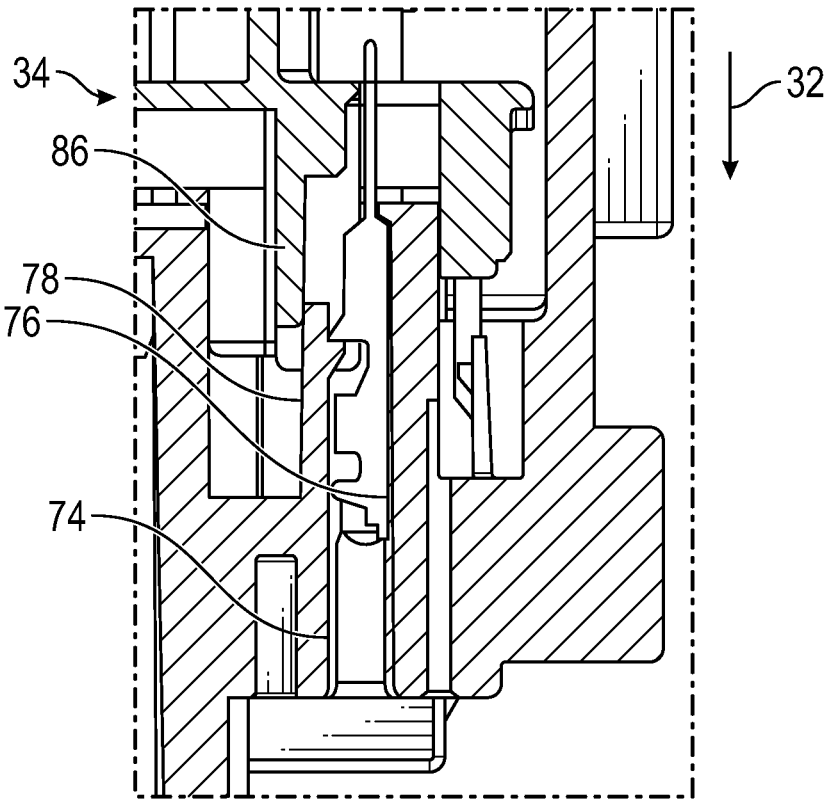
FIG. 10B is a cross-sectional view similar to FIG. 9B, showing a terminal position assurance on the protector plate reinforcing the terminal lock.

Referring to FIG. 10B, there is illustrated a view similar to FIG. 9B, with the protector plate 34 moved to the pre-lock position. As shown, the protector plate 34 includes a plurality of secondary locks 86 that extend from the back plate face 40 of the protector body 36. When the protector plate 34 is in the pre-lock position, the secondary locks 86 are located adjacent the terminal lock 78 on the opposite side from the terminal cavity 74. As a result, the secondary locks 86 act as a reinforcement for the terminal lock 78 and prevent the terminal lock 78 from being operable. Thus, the electrical terminal 76 cannot be removed from the terminal cavity 74. As a result, when the protector plate 34 is located in the pre-lock position, the electrical terminal 76 is retained in the terminal cavity 74.

Figure 11:
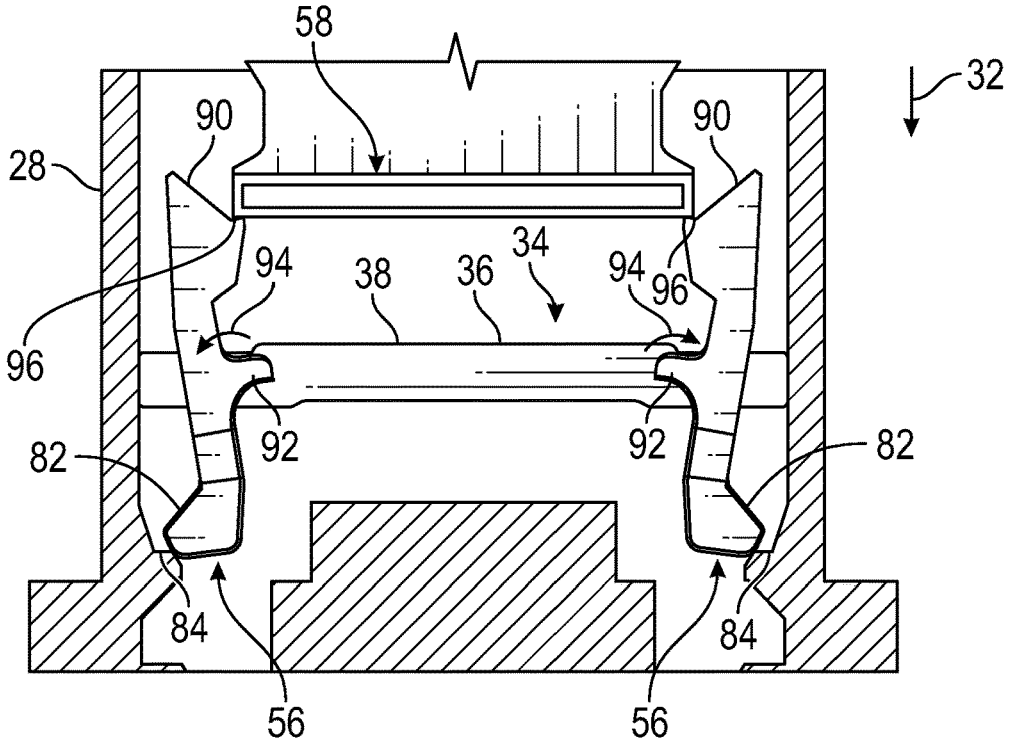
FIG. 11 is a cross-sectional view similar to FIG. 10, showing a second connector assembly inserted into the first connector assembly.

Referring now to FIG. 11, there is illustrated a cross-sectional view similar to FIG. 10, wherein the second connector assembly 26 is shown inserted into the first connector assembly 24. The first connector assembly 24 and the second connector assembly 26 can be mated similarly to the prior art electrical connector assembly 10. The second connector assembly 26 may be manually positioned adjacent to the first connector assembly 24 and moved in the mate direction 32.

Similar to the prior art electrical connector 10, when the first connector assembly 24 and the second connector assembly 26 are initially brought into contact, the towers 42 on the protector plate 34 pass through the tower openings 68 on the second terminal position assurance 58 and enter respective tower guides (not shown) on the second housing 60. During this initial contact, the forward walls 48*a* and the cross walls 48*b* engage complementary walls in the tower guides. This helps to properly position the second connector assembly 26 relative to the first connector assembly 24 before the electrical terminal 76 has engaged any part of the second connector assembly 26.

As illustrated in FIG. 11, the second connector assembly 26 is shown moved in the mate direction 32 so that it engages the protector plate 34. As previously described, the staged locks 56 extend beyond the front plate face 38 of the protector plate 34. As the second connector assembly 26 is moved in the mate direction 32, the second terminal position assurance 58 engages a release surface 90 on the staged lock 56. The release surface 90 is at an angle relative to the mate direction 32. Each staged lock 56 is resiliently attached to the protector body 36 and is able to be rotated relative to the protector body 36 generally about a respective lock axis 92. When the second terminal position assurance 58 engages the release surface 90, the movement of the second terminal position assurance 58 in the mate direction 32 causes the staged lock 56 to be rotated in a release direction, indicated by the arrow 94.

The second terminal position assurance 58 continues to be moved in the mate direction 32 and the staged lock 56 continues to be rotated in the release direction 94 until the second terminal position assurance 58 engages a shoulder 96 on the staged lock 56. The shoulder 96 is located adjacent to the release surface 90 and is substantially perpendicular to the mate direction 32. As shown, the foot 82 on the staged lock 56 has been moved in the release direction 94 and is no longer engaged with the stop 84. The protector plate 34 is now illustrated in a release position. Further movement of the second connector assembly 26 in the mate direction 32 will push against the shoulder 96 and will move the protector plate 34 in the mate direction 32.

Figure 12:
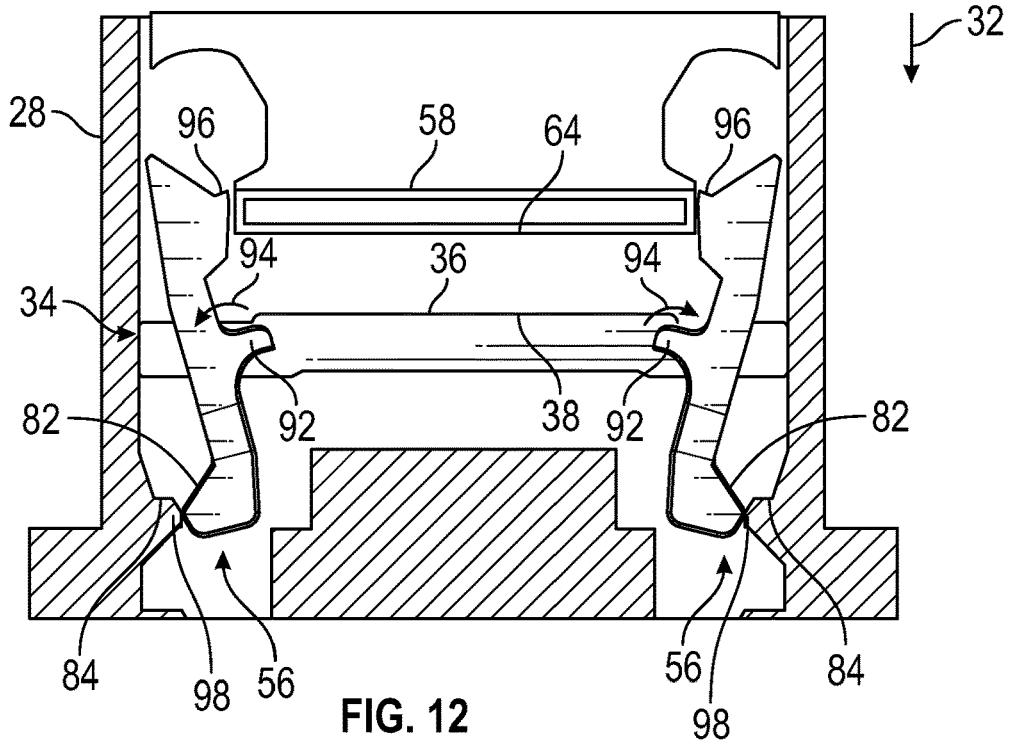
FIGS. 12, 13, and 14 are cross-sectional views similar to FIG. 11 showing various stages of the second connector assembly being mated with the first connector assembly.

Referring to FIG. 12, there is illustrated a cross-sectional view similar to FIG. 11, with the second connector assembly 26 shown moved further in the mate direction 32. The first housing 28 includes a respective foot switch 98 for each staged lock 56. The foot switch 98 includes a surface that is sloped relative to the mate direction 32 that engages the foot 82 when the protector plate 34 is moved in the mate direction 32. The foot switch 98 causes the staged lock 56 to be rotated further in the release direction 94. This causes the shoulder 96 to be moved in the release direction 94 until the second terminal position assurance 58 no longer engages the shoulder 96. The second connector assembly 26 is then able to be moved in the mate direction 32 relative to the protector plate 34 and the end of each of the staged locks 56 is moved into one of the lock openings 72 on the second terminal position assurance 58.

Figure 13:
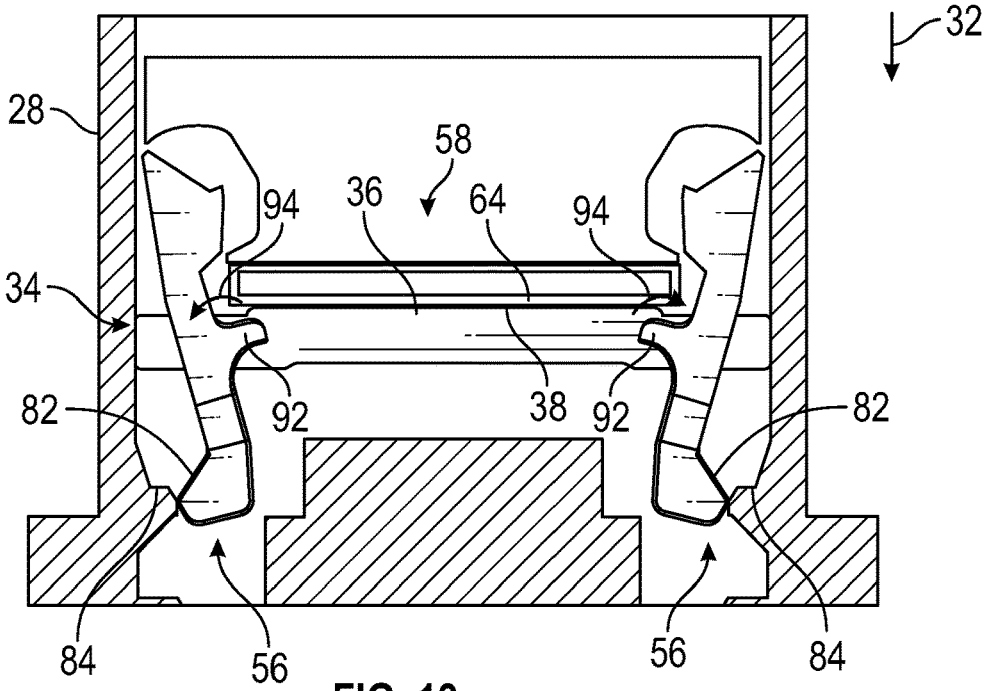

Referring to FIG. 13, there is illustrated a cross-sectional view similar to FIG. 12, with the second connector assembly 26 shown moved further in the mate direction 32. As shown, the second connector assembly 26 is moved in the mate direction 32 until the front face 64 of the second terminal position assurance 58 has engaged the front plate face 38 of the protector plate 34. At this point, further movement of the second connector assembly 26 in the mate direction 32 will push the protector plate 34 in the mate direction 32.

Figure 14:
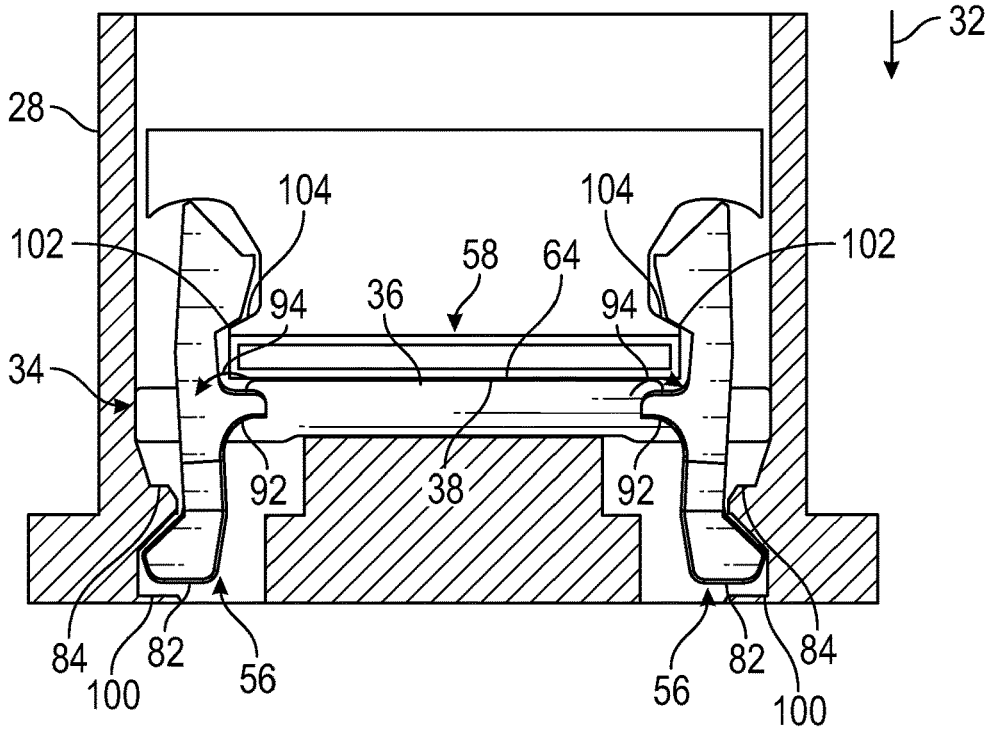

Referring to FIG. 14, there is illustrated a cross-sectional view similar to FIG. 13, with the second connector assembly 26 shown moved further in the mate direction 32 to a seated position. As shown, the protector plate 34 has been moved in the mate direction 32 relative to the first housing 28. The foot 82 has been moved past the foot switch 98, and the resilient staged lock 56 rebounds opposite the release direction 94 into a foot recess 100. Referring back to FIG. 4, in the illustrated embodiment the foot recess 100 is located outside the first housing 28. This allows the assembler to visually confirm that the protector plate 34 has been pushed to all the way to the seated position. Once the protector plate 34 is in the seated position, the staged lock 56 rebounds to a neutral position where there is no stress on the staged lock 56.

The second connector assembly 26 may be moved opposite the mate direction 32 relative to the first connector assembly 24 in order to unmate the electrical connector assembly 22. The staged lock 56 includes a chin 102 that is located opposite the mate direction 32 from a pull-out surface 104 on the second connector assembly 26. In the illustrated embodiment, the pull-out surface 104 is angled relative to the mate direction 32. When the second connector assembly 26 is moved opposite the mate direction 32, the pull-out surface 104 engages the chin 102, and the staged lock 56 is rotated in the release direction 94. The second connector assembly 26 can continue to be moved opposite the mate direction 32, while the protector plate 34 remains in the seated position. When the second connector assembly 26 is moved opposite the mate direction 32 past the shoulder 96, the staged lock 56 can rebound to the neutral position. This allows the second connector assembly 26 to be unmated from the first connector assembly 24 while leaving the protector plate 34 in the seated position shown in FIG. 14.

Figure 15:
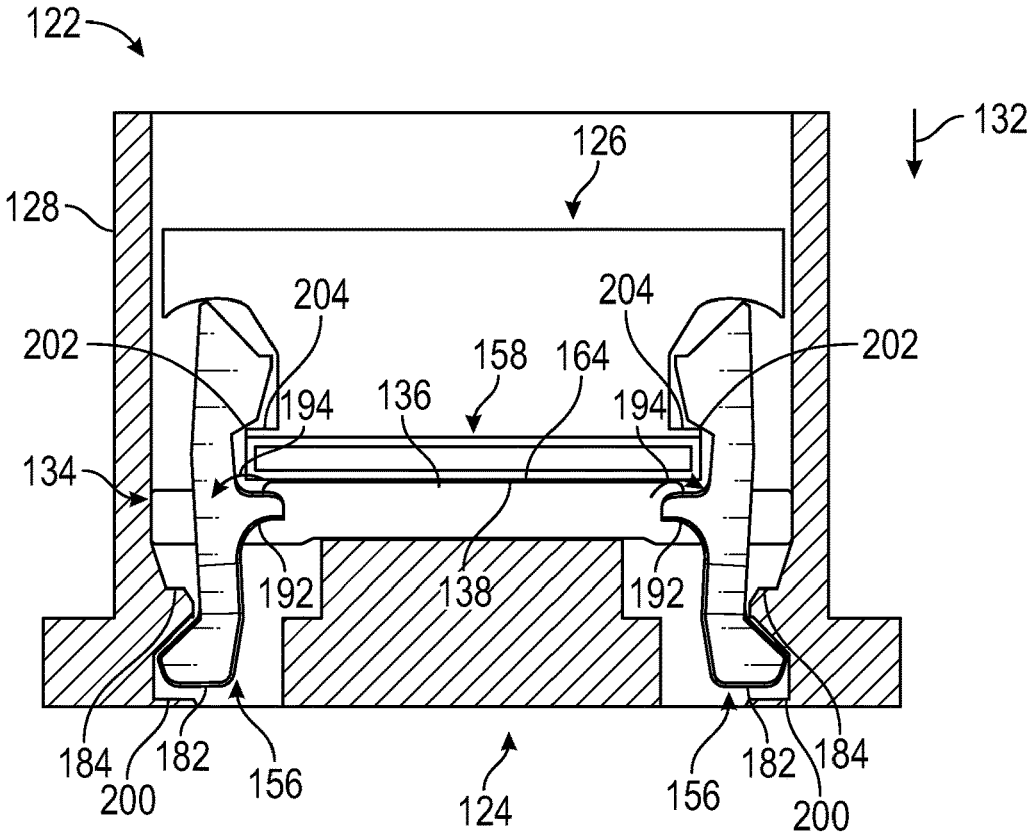
FIG. 15 is a cross-sectional view similar to FIG. 14 of a second embodiment of an electrical connector assembly in accordance with this invention.

Referring now to FIG. 15, there is illustrated a second embodiment of an electrical connector assembly, indicated generally at 122, in accordance with the invention. The illustrated electrical connector assembly 122 is substantially the same as the previously-described electrical connector assembly 22, and similar features are identified by the same element number increased by 100. The view illustrated in FIG. 15 is similar to FIG. 14, with a first connector assembly 124 and a second connector assembly 126 shown in a mated position. The second connector assembly 126 includes a pull-out surface 204 that is generally perpendicular to a mate direction 132.

When the second connector assembly 126 is moved opposite the mate direction 132, the pull-out surface 204 engages a chin 202, and the staged lock 156 is pulled along with the second connector assembly 126 opposite the mate direction 132. This allows the second connector assembly 126 to be unmated from the first connector assembly 124, while pulling a protector plate 134 to the pre-stage position, similar to that shown in FIG. 9A.

Figure 16:
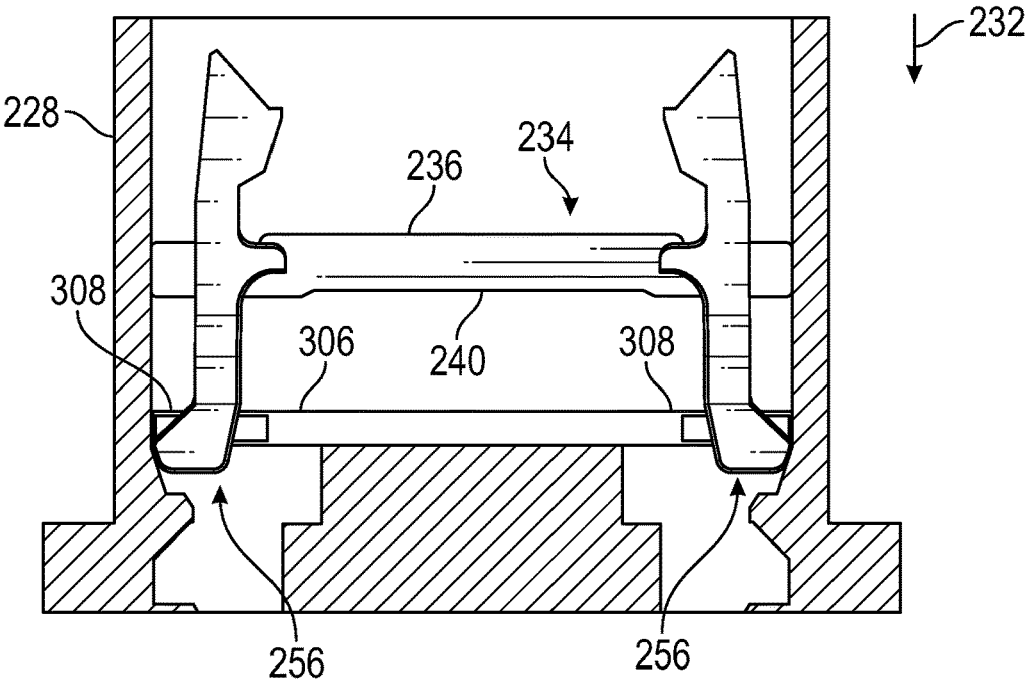
FIG. 16 is a cross-sectional view similar to FIG. 9A of a third embodiment of an electrical connector assembly in accordance with this invention.

Referring now to FIG. 16, there is illustrated a third embodiment of an electrical connector assembly, indicated generally at 222, in accordance with the invention. The illustrated electrical connector assembly 222 includes many features similar to the previously-described electrical connector assembly 22, and similar features are identified by the same element number increased by 200.

The view illustrated in FIG. 16 is similar to FIG. 9A, with a protector plate 234 shown in a pre-stage position in a first connector assembly 224. The first connector assembly 223 includes a terminal position assurance 306. The terminal position assurance 306 is similar to the first terminal position assurance described in the '124 patent, and will not be described in detail here. The terminal position assurance 306 includes lock openings 308 that accommodate staged locks 256 on a protector plate 234. The protector plate 234 differs from the previously described protector plate 34 in that it does not include secondary locks.

Figure 17:
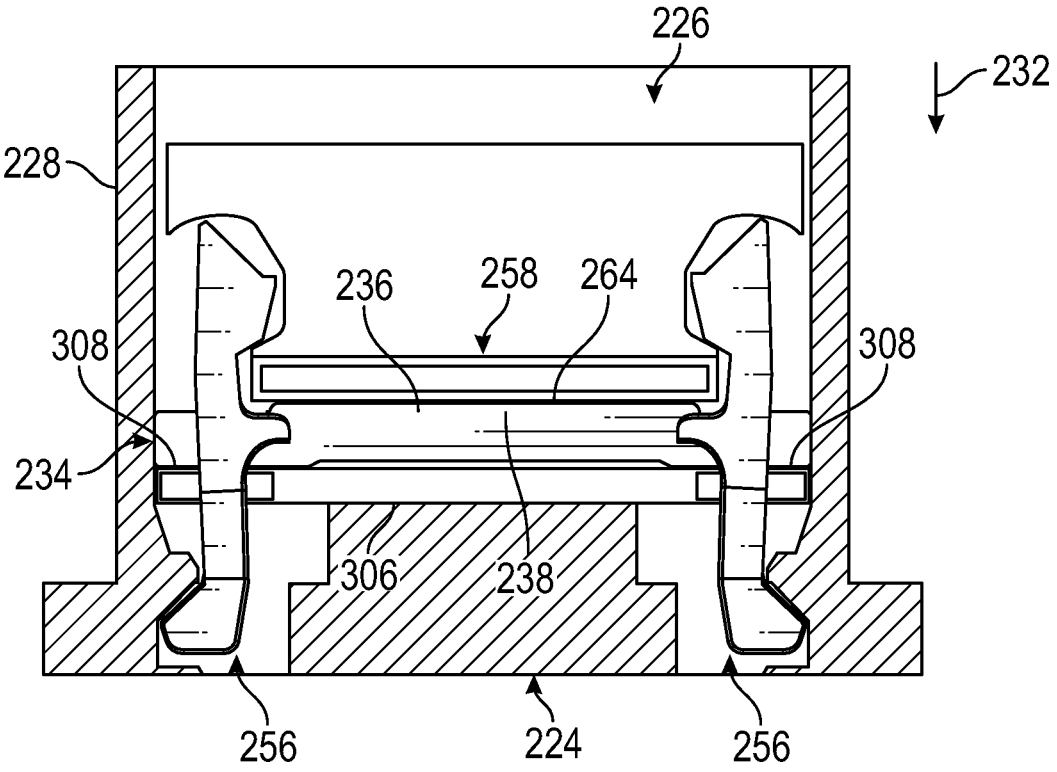
FIG. 17 is a cross-sectional view similar to FIG. 16 showing the electrical connector assembly in a seated position.

The protector plate 234 may be moved from the pre-stage position illustrated in FIG. 16 to a seated position illustrated in FIG. 17 in a manner similar to that previously described in reference to FIGS. 9A-14. When the protector plate 234 is in the seated position, a back plate face 240 on the protector plate 234 is engaged with the terminal position assurance 306 in the first connector assembly 224, while a front place face 238 is engaged with a second terminal position assurance 258 on a second connector assembly 226.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A protector plate for use with an electrical connector, the protector plate comprising: a protector body having a front plate face and an opposed back plate face; one or more terminal openings that pass through the protector body; and a plurality of staged locks attached to the protector body for relative rotational movement, the staged locks extending beyond the front plate face and also extending beyond the back plate face, wherein: one or more protector plate locks extend from the back plate face, and one or more towers extend from the front plate face.

2. The protector plate of claim 1, wherein the head includes a release surface and a shoulder located on one side of the protector plate and a foot located on the opposite side of the protector plate.

3. The protector plate of claim 1, wherein further including secondary locks extend from the back plate face.

4. A connector assembly comprising:

a housing; and a protector plate including a protector body having a front plate face and an opposed back plate face, one or more terminal openings that pass through the protector body, a plurality of staged locks attached to the protector body for relative rotational movement, the staged locks extending beyond the front plate face and also extending beyond the back plate face, and a secondary lock that extends from the back plate face;

the protector plate movable relative to the housing in a mate direction from a pre-stage position to a pre-lock position wherein the protector plate is retained relative to the housing against further movement in the mate direction by the staged lock.

5. The connector assembly of claim 4, wherein the staged lock is moveable relative to the protector body to release the protector plate for movement relative to the housing in the mate direction to a seated position.

6. The connector assembly of claim 5, wherein the staged lock is biased to a neutral position when the protector plate is in the seated position to retain the protector plate in the housing.

7. An electrical connector assembly comprising:

a first connector assembly, including a first housing and a protector plate, the protector plate movable relative to the first housing in a mate direction from a pre-stage position to a pre-lock position wherein a staged lock on the protector plate engages a stop on the first housing to retain the protector plate against further movement in the mate direction relative to the first housing; and a second connector assembly;

wherein the second connector assembly is movable relative to the first connector assembly to engage a release surface on the staged lock to move the staged lock in a release direction to release the protector plate from the stop.

8. The connector assembly of claim 7, further including a shoulder on the staged lock, wherein the second connector assembly is movable relative to the first connector assembly to engage the shoulder to move the protector plate in the mate direction relative to the first housing.

9. The connector assembly of claim 8, further including a foot switch on the first housing, wherein the protector plate is movable relative to the first housing in the mate direction to engage the staged lock and the foot switch to move the staged lock in the release direction to release the second connector assembly from the shoulder.

10. The connector assembly of claim 9, wherein the second connector assembly is moveable relative to the protector plate in the mate direction to engage the protector plate and move the protector plate in the mate direction relative to the first housing to a seated position, wherein the staged lock moves opposite the release direction to a neutral position.

11. The connector assembly of claim 7, further including a terminal cavity defined in the first housing, a terminal lock on the first housing adapted to retain an electrical terminal in the terminal cavity, and a secondary lock on the protector plate;

wherein when the protector plate is in the pre-stage position the terminal lock is operable to allow the electrical terminal to be removed from the terminal cavity and wherein when the protector plate is in the pre-lock position the secondary lock engages the terminal lock to prevent the electrical terminal from being removed from the terminal cavity.

12. The connector assembly of claim 11, further including a shoulder on the staged lock, wherein the second connector assembly is movable relative to the first connector assembly to engage the shoulder to move the protector plate in the mate direction relative to the first housing.

13. The connector assembly of claim 12, further including a foot switch on the first housing, wherein the protector plate is movable relative to the first housing in the mate direction to engage the staged lock and the foot switch to move the staged lock in the release direction to release the second connector assembly from the shoulder.

14. The connector assembly of claim 13, wherein the second connector assembly is moveable relative to the protector plate in the mate direction to engage the protector plate and move the protector plate in the mate direction relative to the first housing to a seated position, wherein the staged lock moves opposite the release direction to a neutral position.

15. The connector assembly of claim 11, wherein the secondary lock acts as a terminal position assurance for the terminal cavity.

16. A protector plate for use with an electrical connector, the protector plate comprising:

a. protector body having a front plate face and an opposed back plate face; one or more terminal openings that pass through the protector body; and plurality of staged locks attached to the protector body for relative rotational movement the staged locks extending beyond the front plate face and also extending beyond the back plate face, wherein the staged locks include a head located on one side of the protector plate and a foot located on the opposite side of the protector plate and wherein the head includes a release surface and a shoulder located on one side of the protector plate and a foot located on the opposite side of the protector plate.

17. The protector: plate of claim 16, wherein one or more protector plate locks that extend from the back plate face, and one or more towers that extend from the front plate face.

18. The protector plate of claim 16, wherein secondary locks extending from the back plate face.

19. A protector plate for use with an electrical connector, the protector plate comprising:

a protector body having a front plate face and an opposed back plate face; one or more terminal openings that pass through the protector body; and a plurality of staged locks attached to the protector body for relative rotational movement, the staged locks extending beyond the front plate face and also extending beyond the back plate face, wherein secondary locks extend from the back plate face.

20. The protector plate of claim 19, wherein one or more protector plate locks extend from the back plate face, and one or more towers extend from the front plate face.

21. The protector plate of claim 19, wherein the staged locks include a head located on one side of the protector plate and a foot located on the opposite side of the protector plate, and wherein the head includes a release surface and a shoulder located on one side of the protector plate and a foot located on the opposite side of the protector plate.

* * * * *